US005365894A

United States Patent [19]

Hackett

[11] Patent Number: 5,365,894

[45] Date of Patent: Nov. 22, 1994

[54] VALVE ACTUATION DEVICE

[75] Inventor: David E. Hackett, Washington, Ill.

[73] Assignee: Caterpillar Inc., Peoria, Ill.

[21] Appl. No.: 980,797

[22] PCT Filed: Sep. 3, 1991

[86] PCT No.: PCT/US91/06227

§ 371 Date: Sep. 3, 1991

§ 102(e) Date: Sep. 3, 1991

[87] PCT Pub. No.: WO93/05278

PCT Pub. Date: Mar. 18, 1993

[51] Int. Cl.[5] ..... F01L 1/26

[52] U.S. Cl. ..... 123/90.22; 123/90.4

[58] Field of Search ..... 123/90.22, 90.23, 90.27, 123/90.4, 308, 315, 432

[56] References Cited

U.S. PATENT DOCUMENTS

| | | | |
|---|---|---|---|
| 3,613,647 | 10/1971 | Mettig et al. | 123/90.22 |
| 4,327,677 | 5/1982 | Vander Bok | 123/90.4 |
| 4,343,268 | 8/1982 | Stang et al. | 123/90.4 |
| 4,624,222 | 11/1986 | Yoshikawa | 123/90.27 |
| 4,658,780 | 4/1987 | Hosoi | 123/315 |
| 4,677,723 | 7/1987 | Greene, Sr. | 29/157.1 |
| 4,791,893 | 12/1988 | Muranaka et al. | 123/90.4 |
| 4,825,822 | 5/1989 | Muranaka et al. | 123/90.44 |
| 4,907,554 | 3/1990 | Bergeron | 123/432 |
| 4,913,104 | 4/1990 | Mills | 123/90.4 |
| 4,922,867 | 5/1990 | Mathews | 123/90.22 |
| 4,944,256 | 7/1990 | Matayoshi et al. | 123/90.24 |
| 5,150,672 | 9/1992 | Fischer et al. | 123/90.22 |

FOREIGN PATENT DOCUMENTS 1007502 5/1952 France .

*Primary Examiner*—E. Rollins Cross
*Assistant Examiner*—Weilun Lo
*Attorney, Agent, or Firm*—Diana L. Charlton

[57] ABSTRACT

The use of devices to simultaneously actuate multiple valves operatively associated with a common combustion chamber is becoming more important due to the increase in multiple valve internal combustion engines. The ability to simultaneously actuate multiple valves reduces weight, costs, and parts in the engine. The subject valve actuation device (10) has a valve arrangement (12) with at least three valves (14, 15, and 16) having stem portions (40, 41, and 42) operatively associated with a common combustion chamber (22). A free-floating bridge (62) having three recesses (64, 65, and 66) is seated on the stem portions (40, 41, and 42). A movable rocker arm (34) having two fingers (36 and 37) contacts the free-floating bridge (62) at locations sufficient to actuate the valves (14, 15 and 16) simultaneously.

5 Claims, 7 Drawing Sheets

VALVE ACTUATION DEVICE

TECHNICAL FIELD

This invention relates to internal combustion engines and more particularly to a valve actuation device therefor.

BACKGROUND ART

It is well known that the specific output of an internal combustion engine can be increased by using a plurality of valves for each combustion chamber. For this reason, it is becoming more commonplace to have multiple valves operatively associated with a common combustion chamber, particularly in high performance engines. As a result, methods and devices are described in the prior art for simultaneously operating two or more valves to reduce weight, cost, and parts in the valvetrain.

One prior art reference discloses a four valve design which uses a single rocker arm to operate two of the four valves simultaneously, while the remaining two valves are operated by two separate conventional rocker arms. The single rocker arm operating the two valves simultaneously has a Y-shaped body with ends which seat on the ends of the two valve stems. Therefore, the actuation force is applied directly to the valves. By utilizing this design, three rocker arms are used to operate four valves operatively associated with a common combustion chamber. Normally, four separate rocker arms would be used for the actuation of four valves.

In the same manner, another prior art device utilizes a bridge mechanism to simultaneously operate two valves of an internal combustion engine. The bridge mechanism is guided between the two valves at the center of the forces and is actuated by a rocker arm whose contact point on the bridge is located on an extension of the guiding means for the bridge.

In order to reduce the number of rocker arms even further, a prior art device having five valves operatively associated with a common combustion chamber uses a single rocker arm to operate three valves simultaneously and an additional rocker arm to operate the remaining two valves. The rocker arms have fingers which contact the valve stems, with each of the five fingers requiring an adjustor to position the valves.

It is evident from the prior art described that the simultaneous actuation of multiple valves operatively associated with a common combustion chamber of an internal combustion engine requires the use of an adjustor for each valve or a bridge with a guiding mechanism and adjustor for all but one valve per bridge.

The present invention minimizes the use of valve adjustors and eliminates bridge guiding mechanisms in a simplified device that accomplishes the simultaneous actuation of multiple valves operatively associated with a common combustion chamber.

The present invention also accomplishes simultaneous actuation of multiple valves in a device that provides improved reliability and assembleability over the prior art at substantially the same costs.

DISCLOSURE OF THE INVENTION

In one aspect of the present invention a valve actuation device is provided for an internal combustion engine. The valve actuation device has a valve arrangement with at least three valves operatively associated with a common combustion chamber. The valves each have a stem portion supporting the valves for reciprocation along their respective axis. A free-floating bridge is seated on the stem portions of the valves. Means are provided for applying a force to the free-floating bridge at a contact point sufficient for actuating the valves simultaneously.

The disadvantage of the prior art is that simultaneous actuation of multiple valves is obtained, but more parts, such as, valve adjustors, rocker arms, and bridge guiding mechanisms are needed. The excessive parts necessary for the prior art devices increase the weight of the valvetrain. The present invention simultaneously operates three valves operatively associated with a common combustion chamber through the use of a free-floating bridge which is seated on the ends of the valve stems. The present invention minimizes the use of adjustors while totally eliminating the use of bridge guiding mechanisms. The present invention actuates the three valves simultaneously in a manner that enhances assembleability and reliability at substantially the same cost as the prior art devices.

BEST MODE FOR CARRYING OUT THE INVENTION

Figure 1:
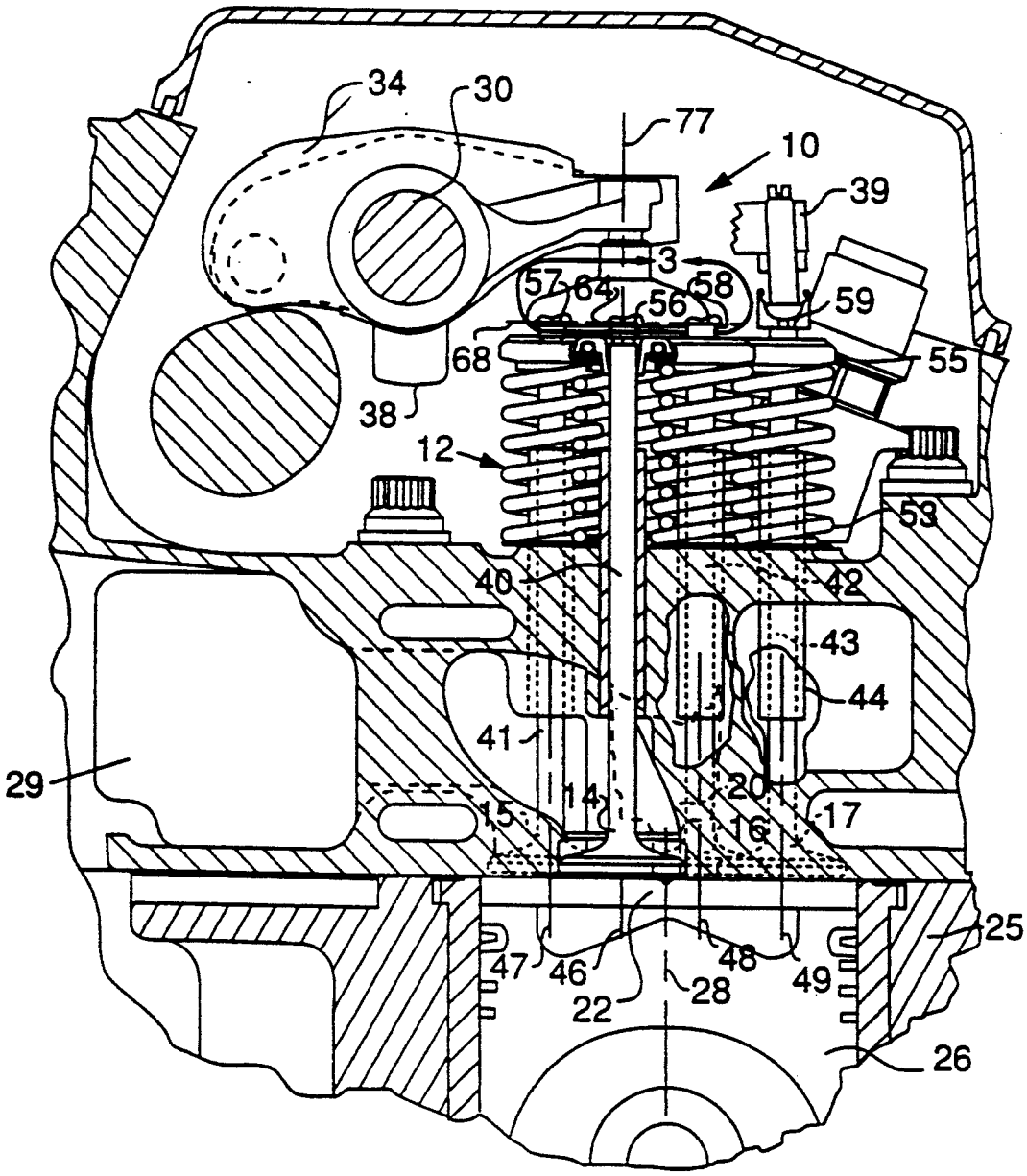
FIG. 1 is a view taken along 1-1 in FIG. 2 diagrammatically illustrating an internal combustion engine valve arrangement including an embodiment of the present invention.
Figure 2:
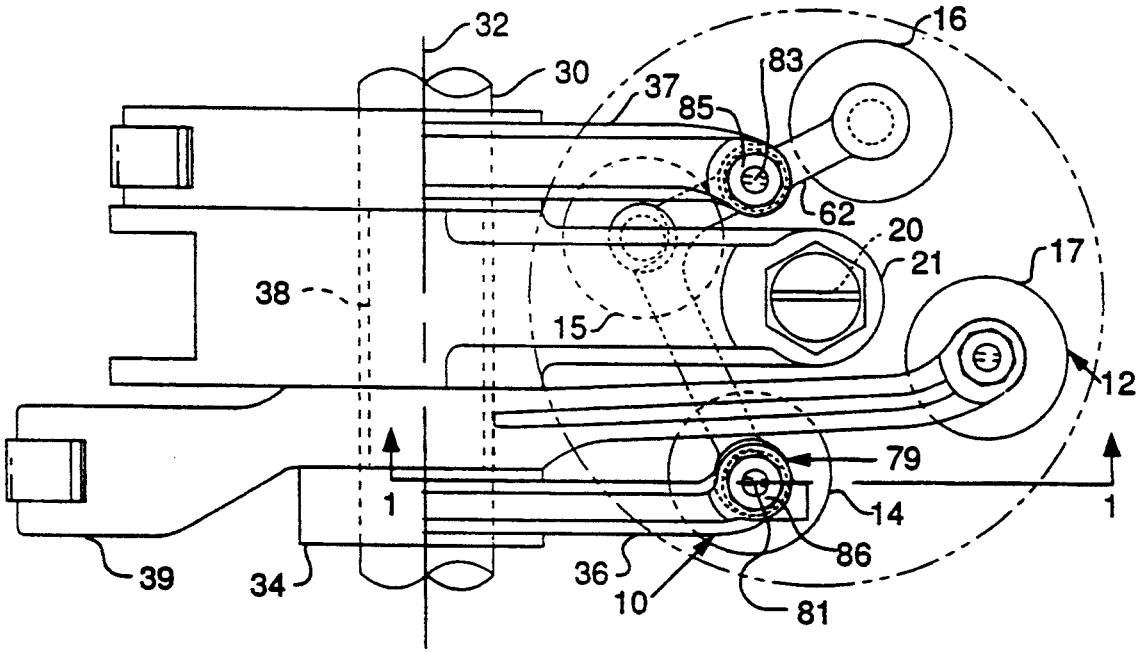
FIG. 2 is a diagrammatic plan view of the embodiment of FIG. 1.

A valve actuation device 10 for an internal combustion engine having a valve arrangement 12 is shown in FIGS. 1 & 2 with three intake valves 14, 15, and 16, an exhaust valve 17, and a fuel injection nozzle 20 having an associated rocker arm 21 operatively associated with a common combustion chamber 22. The combustion chamber 22 is conventionally mounted in a cylinder block, partially shown at 25, and is defined in part by a piston 26 which reciprocates along a respective axis 28. The valves 14, 15, 16, and 17 are conventionally mounted in a cylinder head partially shown at 29. A shaft 30 having a longitudinal axis 32 is suitably mounted on the cylinder head 29. A movable rocker arm 34 having two spaced apart fingers 36 and 37 is pivotably mounted on the shaft 30 to actuate the intake valves 14, 15, and 16 through conventional camshaft means or any suitable actuation method. A strap 38 is used to connect the two fingers 36 and 37 under the shaft 30 or in any suitable location parallel to but offset from the shaft 30. Another movable rocker am 39 is pivotably mounted on the shaft 30 to actuate the exhaust valve 17 through conventional camshaft means or any suitable actuation method.

Figure 3:
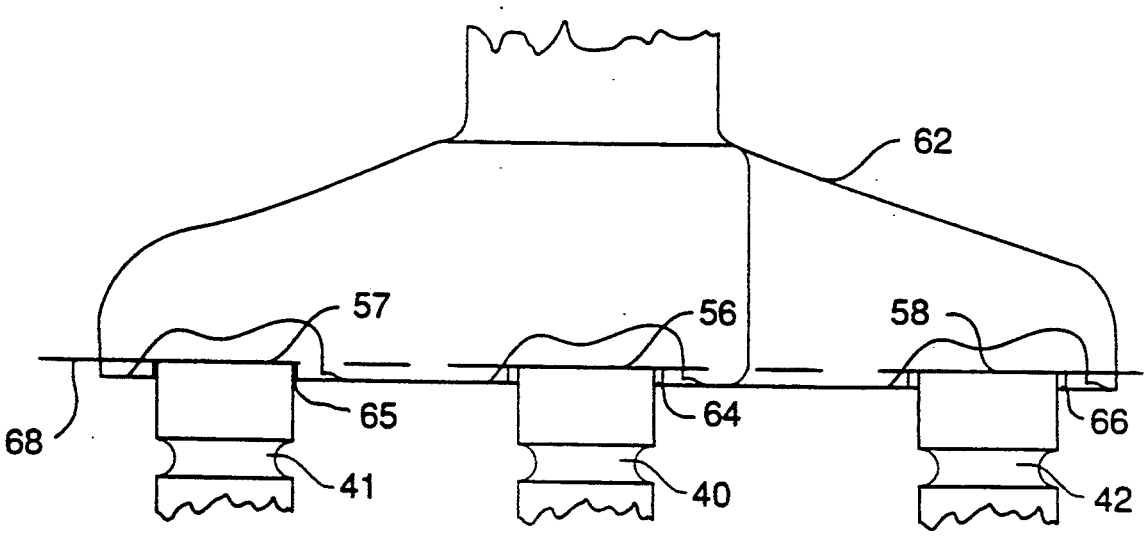
FIG. 3 is an enlarged view encompassed by the line 3 of FIG. 1.
Figure 4:
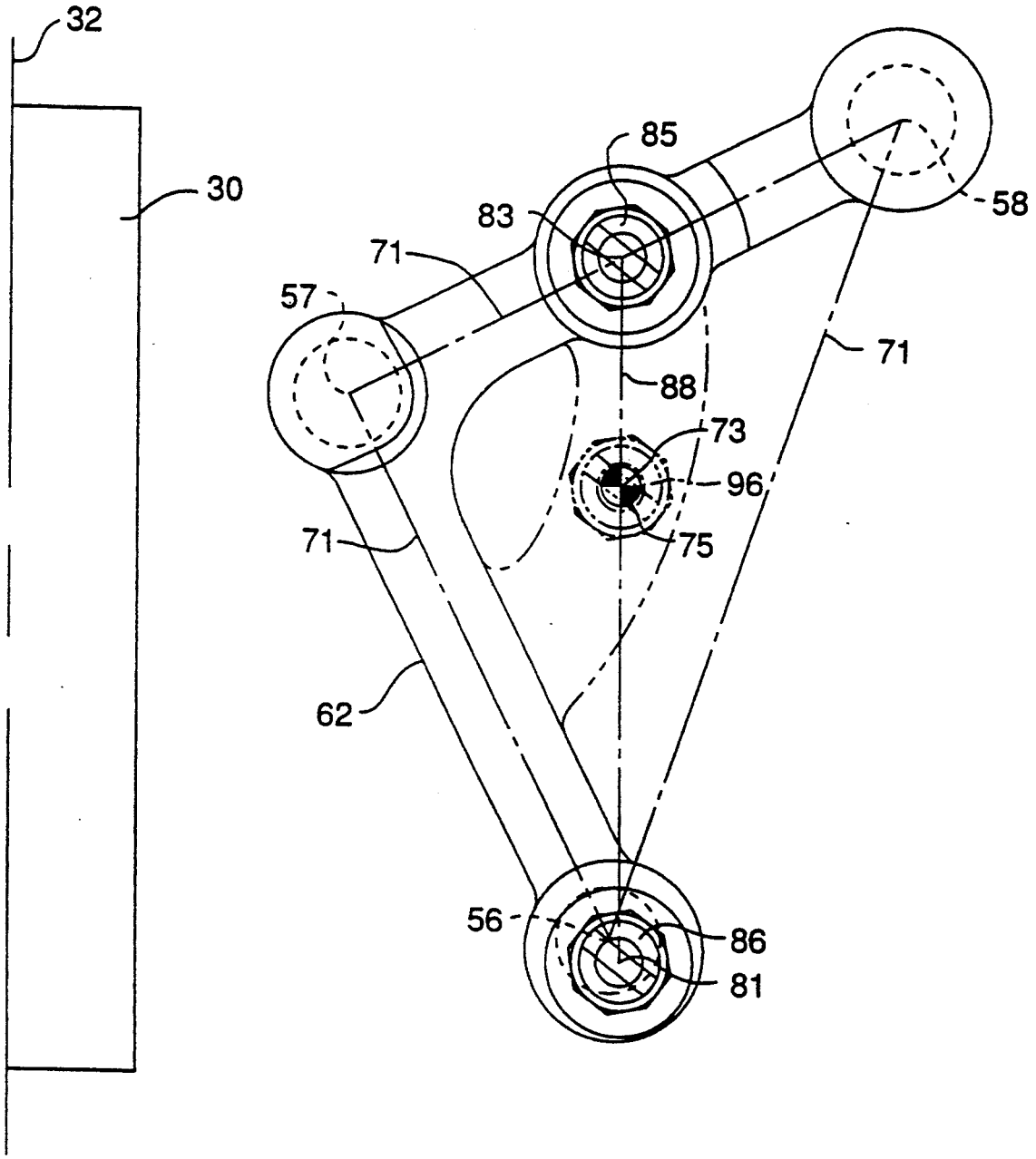
FIG. 4 is an enlarged partial plan view of FIG. 3 showing the establishment of the contact points for the invention.

Each of the valves 14, 15, 16, and 17 has a stem portion 40, 41, 42, and 43, respectively, which are supported for reciprocation in the cylinder head 29 in a conventional manner, such as by valve guiding mechanisms, one of which is shown at 44. The valves 14, 15, 16, and 17 are adapted for reciprocation along respective parallel and non-coplanar axes 46, 47, 48, and 49 defined by the stem portions 40, 41, 42, and 43. The valves 14, 15, 16, and 17 are movable between a first position at which the valves are opened and a second position at which the valves are closed. Coil springs, one of which is shown at 53, encircle the valves 14, 15, 16, and 17 and act against keepers, one of which is shown at 55, for urging the valves 14, 15, 16, and 17 to their closed position. Each of the valve stem portions 40, 41, 42, and 43 has a valve end 56, 57, 58, and 59. A bellcrank shaped free-floating bridge 62, is shown in FIGS. 3 & 4, having three recesses 64, 65, and 66, such as bores, which are seated on the stem portions 40, 41, and 42 of the intake valves 14, 15, and 16. The valve ends 56, 57, and 58, define a plane 68 when the valves 14, 15, and 16 are in the closed or second position. The valve ends 56, 57, and 58 of the intake valves 14, 15, and 16 are arranged in a geometric shape, such as a triangle, which is shown with imaginary lines 71 in FIG. 4. The geometric shape has a centroid 73 which is established by a known formula and lies on the plane 68. The mass of the free floating bridge 62 has a center of gravity 75. In the present embodiment shown in FIGS. 1–4, the center of gravity 75 lies on a line 77, shown in FIG. 1, which is located substantially at the centroid 73 of the geometric shape and perpendicular to the plane 68.

The valve actuation device 10, provides a means 79 for applying a force at a pair of contact points 81 and 83 on the free-floating bridge 62 for actuating the intake valves 14, 15, and 16 simultaneously. The force applying means 79 includes the shaft 30 mounted to the cylinder head 29 and the movable rocker arm 34. The two fingers 36 and 37 of the movable rocker am 34 are urged during actuation into contact with the free-floating bridge 62. The fingers 36 and 37 have a pair of adjustors 85 and 86 releasably secured thereto for contacting the free-floating bridge 62 at the contact points 81 and 83. Another plane 88 is defined which passes through the centroid 73 parallel to the longitudinal axis 32 of the shaft 30 and perpendicular to the plane 68. The contact points 81 and 83 lie along the plane 88.

Figure 5:
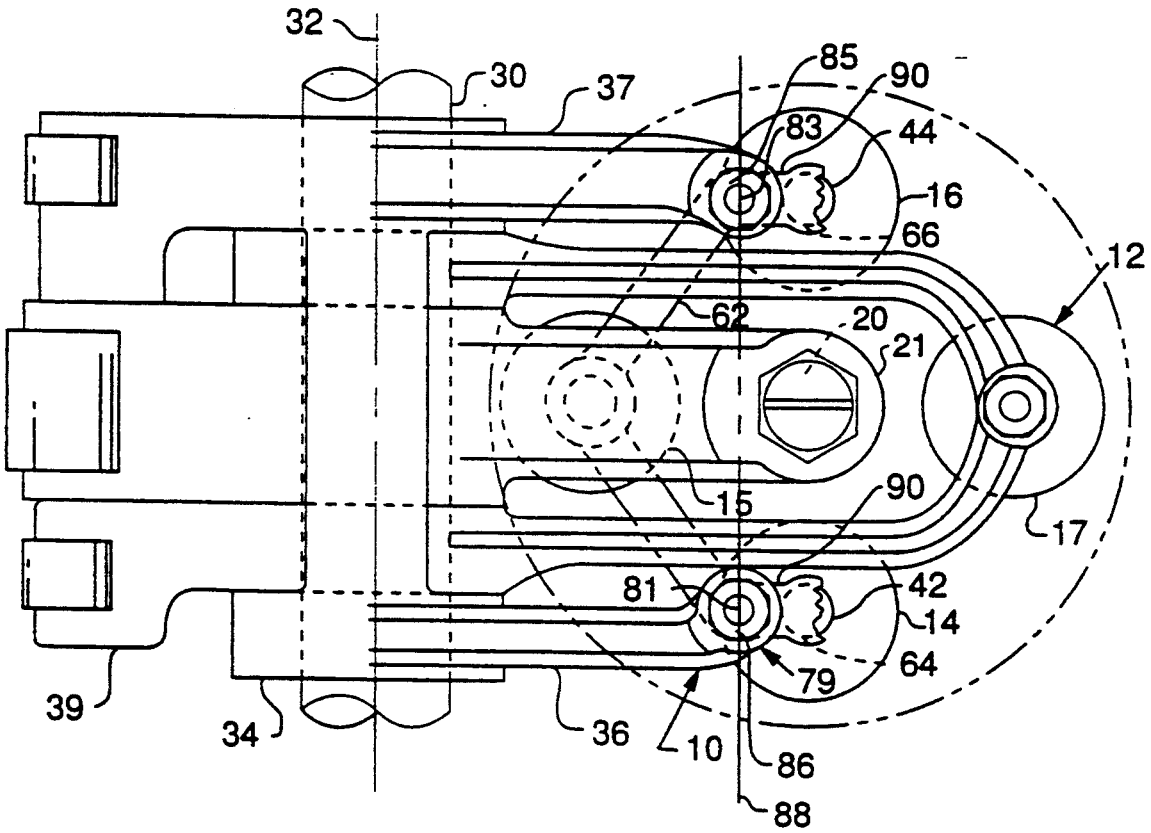
FIGS. 5–7 are diagrammatic plan views of other embodiments of the invention showing the valve arrangements in various orientations.
Figure 6:
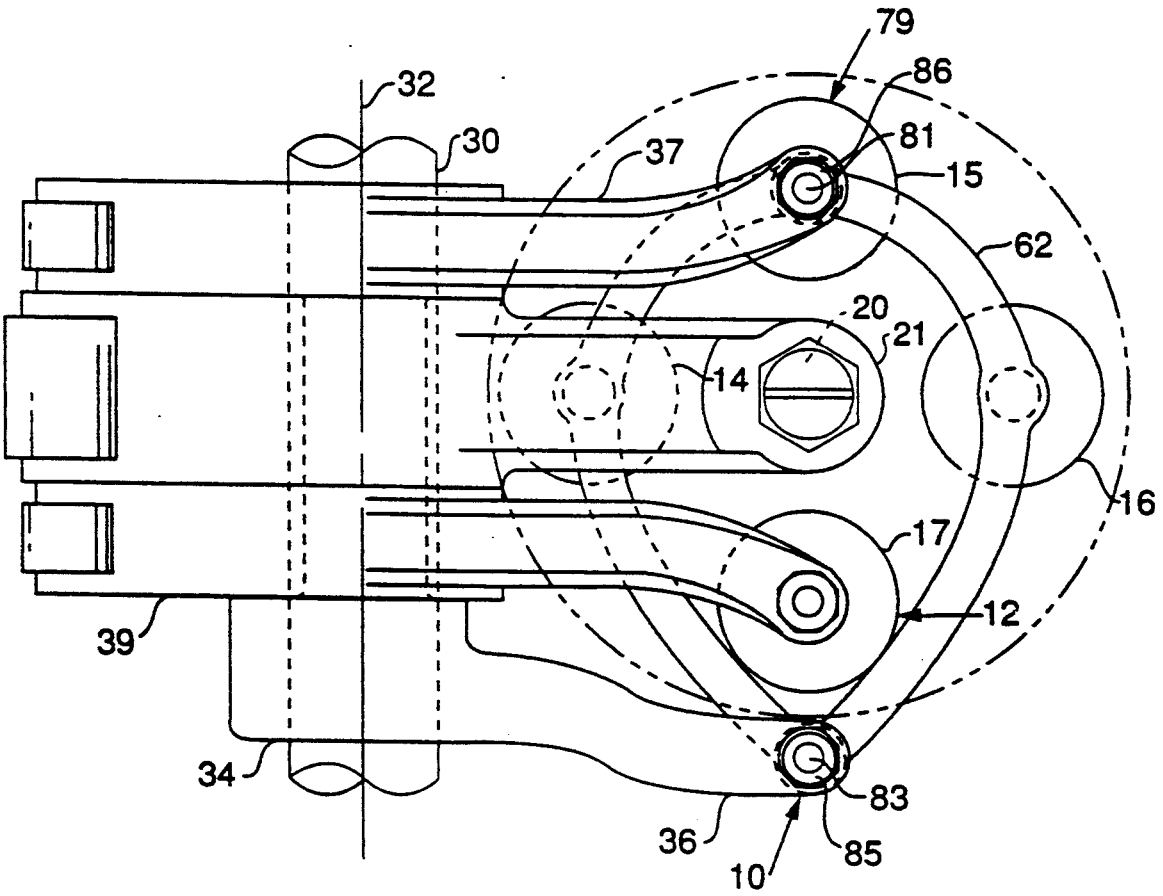
Figure 7:
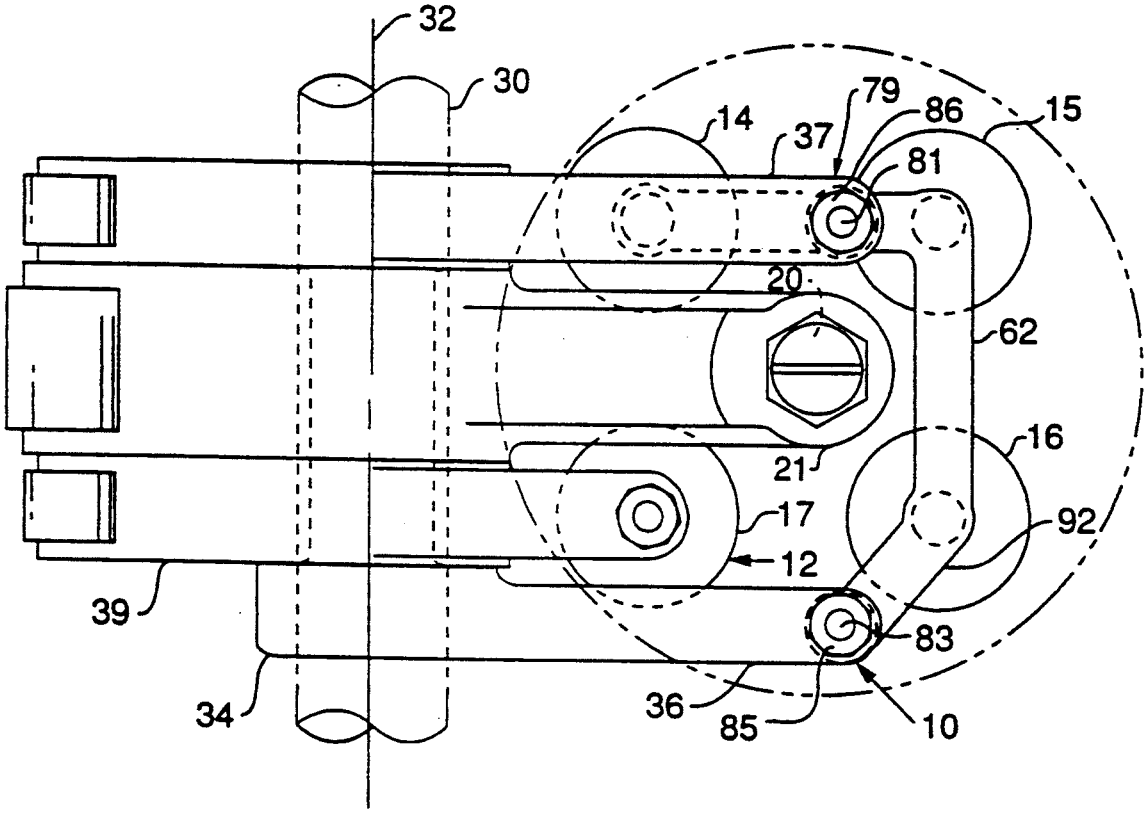

Other embodiments of the present invention are shown in FIGS. 5–7. It should be noted that the same reference numerals of the first embodiment are used to designate similarly constructed counterpart elements of these embodiments. The valve arrangements for the other embodiments are shown in slightly different orientations. It should be understood that the principles and techniques for the first embodiment described can be applied to the other embodiments shown and to any various orientations of the valves.

The free-floating bridge 62 shown in FIG. 5 is constructed with a pair of additional extensions 90 so that the contact points 81 and 83 could be located on the free-floating bridge 61 along the plane 88 and not interfere with the exhaust rocker arm 39. The extensions 90 have the recesses 64 and 66 provided therein to seat the free-floating bridge 62 on the stem portions 40 and 42 of the intake valves 14 and 16. Due to spatial capacity, the rocker arm 39 has a U-shaped configuration to actuate the exhaust valve 17.

The free-floating bridge 62 shown in FIG. 6 is constructed in a generally oval shape. The contact point 83 is constructed outside the valve arrangement 12 due to the spatial limitations set forth by the position of the fuel nozzle 20 and the exhaust rocker am 39.

The free-floating bridge 62 shown in FIG. 7 is constructed so that an additional extension 92 is provided for the location of the contact point 83.

Although two contact points 81 and 83 are shown in the embodiments, it should be noted that a single contact point 96 on the free-floating bridge 62 could be used to actuate the intake valves 14, 15, and 16 as shown in FIG. 4. The single contact point 96 would contact the free-floating bridge 62 at the centroid 73 of the geometric shape. Moreover, although the center of gravity 75 is preferably located substantially at the centroid 73 it should be noted that the center of gravity 75 may be offset from the centroid 73.

INDUSTRIAL APPLICABILITY

The valve actuation device 10 provides the ability to actuate at least three valves 14, 15, and 16 simultaneously. In use, the movable rocker arm 34 pivots around the shaft 30 upon actuation through conventional camshaft means or any suitable actuation method. The two fingers 36 and 37 of the movable rocker arm 34 come into contact with the free-floating bridge 62 for applying a compressive force at contact points 81 and 83 via two adjustors 85 and 86.

The contact points 81 and 83 are established on the free-floating bridge 62 through a combination of geometric and structural relationships. The centroid 73 of the geometric shape is found through a known formula. Once the centroid 73 is found, the plane 88 which passes through the centroid 73 parallel to the longitudinal axis 32 of the shaft 30 and perpendicular to the plane 68, is used to establish contact points 81 and 83. The contact points 81 and 83 are arbitrarily chosen at any location along the plane 88. The free-floating bridge 62 is constructed to fit the locations chosen for the contact points 81 and 83. The contact points 81 and 83 are shown on opposite sides of the centroid 73 at locations which do not interfere with the rocker arm of the fuel injection nozzle exhaust valve 21 and 39. The plane 88 is parallel to the longitudinal axis 32 of the shaft 30 to ensure uniform actuation of the valves 14, 15, and 16. The free-floating bridge 62 is inherently stable statically since it is supported at three non-aligned points defined by the valve ends 56, 57, and 58 of the valves 14, 15, and 16. Since the valve ends 56, 57, and 58 define a plane 68 and the free-floating bridge is seated along that plane, the valve adjustors 85 and 86 can be used to establish a predetermined working relationship between the two fingers 36 and 37 and the free-floating bridge 62. Therefore, the valves 14, 15, and 16 no longer need individual valve adjustors. Dynamic stability is achieved by judicious distribution of mass of the free-floating bridge 62 so that the center of gravity 75 of the free-floating bridge 62 is substantially at the centroid 73 of the geometric shape.

In view of the above, it is apparent that the present invention provides an improved means to actuate multiple valves simultaneously. The present invention utilizes a simplified design comprising a free-floating bridge and a geometric relationship between the geometric shape defined by the valves ends, the rocker arm shaft, and the contact points on the free-floating bridge. The present invention enhances the assembleability and reliability of the structure while minimizing valve adjustors and eliminating bridge guiding mechanisms

I claim:

1. A valve actuation device for an internal combustion engine having a cylinder head and a valve arrangement with at least three valves operatively associated with a common combustion chamber, each of the valves having a stem portion for reciprocation along a respective axis, comprising:

the valves are movable between a first position at which the valves are opened and a second position at which the valves are closed, each of the stem portion of the valves having a valve end, the valve ends defining a plane when the valves are in the second position and being arranged in a geometric shape having a centroid;

a free-floating bridge seated on the stem portions of the valves;

means for applying a force to the free-floating bridge at a first contact point and a second contact point sufficient for actuating the valves simultaneously, the force applying means including a shaft mounted on the cylinder head and a movable rocker arm pivotably mounted on the shaft, the rocker arm having a first finger contacting the free-floating bridge at the first contact point and a second finger contacting the free-floating bridge at the second contact point;

another plane is defined which passes through the centroid parallel to the longitudinal axis of the shaft and perpendicular the first mentioned plane; and the first and second fingers contact the free-floating bridge at points on opposite sides of the centroid of the geometric shape at any location along the another plane, the first contact point being a predetermined distance from the centroid and the second contact point being a predetermined distance from the centroid which is different than the predetermined distance between the first contact point and the centroid.

2. The valve actuation device (10) of claim 1, wherein the free-floating bridge (62) has a plurality of recesses (64, 65, 66) individually receiving the stem portions (40, 41, 42) of the valves (14, 15, 16).

3. The valve actuation device (10) of claim 2, wherein the recesses (64, 65, 66) are bores.

4. The valve actuation device (10) of claim 1, wherein the geometric shape is a triangle.

5. The valve actuation device (10) of claim 1, wherein the mass of the free-floating bridge (62) has a center of gravity (75), and the center of gravity (75) lies on a line (77) which is located substantially at the centroid (73) of the geometric shape and perpendicular to the plane (68).

* * * * *